US006136129A

United States Patent [19]

Petkovsek

[11] Patent Number: 6,136,129

[45] **Date of Patent: *Oct. 24, 2000**

[54] LABEL SYSTEM AND METHOD FOR DELIVERING MAILPIECE WITH RETURN RECEIPT

[76] Inventor: Glenn Petkovsek, 2 Saverne Cir., Little Rock, Ark. 72223

[ * ] Notice: This patent issued on a continued prosecution application filed under 37 CFR 1.53(d), and is subject to the twenty year patent term provisions of 35 U.S.C. 154(a)(2).

[21] Appl. No.: 08/994,907

[22] Filed: Dec. 19, 1997

[51] Int. Cl.[7] ..... B65C 1/02; B42D 15/00

[52] U.S. Cl. ..... 156/247; 156/249; 156/277; 156/DIG. 2; 283/81; 283/94; 283/101; 283/105; 428/41.7; 428/43; 428/42.3

[58] Field of Search ..... 156/247, 249, 156/277, 289, 297, 299, 252, 253, DIG. 2; 283/81, 94, 101, 105; 428/41.7, 41.8, 42.3, 343, 350, 43

[56] References Cited

U.S. PATENT DOCUMENTS

| | | | |
|---|---|---|---|
| 2,805,816 | 9/1957 | Morgan . | |
| 3,937,492 | 2/1976 | Biron . | |
| 3,968,927 | 7/1976 | Katz et al. . | |
| 3,987,960 | 10/1976 | Gardiner . | |
| 4,368,903 | 1/1983 | Jones . | |
| 4,614,361 | 9/1986 | Foster | 283/81 X |
| 4,809,905 | 3/1989 | Goodman . | |
| 4,983,438 | 1/1991 | Jameson . | |
| 5,039,652 | 8/1991 | Doll et al. . | |
| 5,071,167 | 12/1991 | O'Brien . | |
| 5,183,203 | 2/1993 | Sanders . | |
| 5,190,210 | 3/1993 | Walz . | |
| 5,240,456 | 8/1993 | Ochiai | 283/81 X |
| 5,267,898 | 12/1993 | Doll et al. . | |
| 5,299,979 | 4/1994 | Ballard | 283/81 X |
| 5,316,208 | 5/1994 | Petkovsek . | |
| 5,325,303 | 6/1994 | Walz . | |
| 5,383,686 | 1/1995 | Laurash . | |
| 5,421,778 | 6/1995 | Kouramanis . | |
| 5,476,698 | 12/1995 | Denny | 283/81 X |
| 5,484,168 | 1/1996 | Chigot | 283/81 X |
| 5,486,021 | 1/1996 | Laurash . | |
| 5,501,393 | 3/1996 | Walz . | |
| 5,507,526 | 4/1996 | Petkovsek . | |
| 5,520,990 | 5/1996 | Rotermund | 283/81 X |
| 5,547,227 | 8/1996 | Laurash . | |
| 5,573,277 | 11/1996 | Petkovsek | 283/81 X |
| 5,601,313 | 2/1997 | Konkol et al. | 283/81 |
| 5,626,286 | 5/1997 | Petkovsek . | |
| 5,626,370 | 5/1997 | Petkovsek . | |
| 5,633,071 | 5/1997 | Murphy | 428/42.2 X |
| 5,664,725 | 9/1997 | Walz . | |
| 5,697,648 | 12/1997 | Petkovsek | 283/81 X |
| 5,704,650 | 1/1998 | Laurash et al. | 283/81 |

(List continued on next page.)

*Primary Examiner*—Curtis Mayes
*Attorney, Agent, or Firm*—Patents & TMS, P.C.

[57] ABSTRACT

A label useful in delivering packages and articles via many different mailing services. The label is adapted to indicate thereon mailing and address information relating to the mailing, shipping or handling of packages or articles. The label is constructed as a laminate having at least a primary layer and a secondary layer wherein each layer has a surface confronting and adjoined to the other layer. The label has an exposed front side defined on the primary layer and an exposed back side defined on the secondary layer. Pertinent mailing information is included on the exposed front side and may include a plurality of printed instructions and information and also include spaces for receiving additional mailing information thereon. The label has a tear line provided on the primary layer which defines a removable receipt flap on the label. The receipt flap contains a portion of the mailing information and is also adapted to receive thereon additional information as well. An area is exposed beneath the receipt flap on the secondary layer when the receipt flap is removed from the primary layer along the tear line. The exposed area is adapted to show at least a portion of the additional information added to the receipt flap prior to its removal.

27 Claims, 4 Drawing Sheets

U.S. PATENT DOCUMENTS 5,746,450 5/1998 Petkovsek ..... 283/81 X
5,752,722 5/1998 Moore et al. ..... 283/81
5,776,571 7/1998 Michlin et al. ..... 283/81 X
5,848,809 12/1998 Petkovsek ..... 283/81 X
5,860,904 1/1999 Petkovsek .
5,887,904 3/1999 Petkovsek ..... 283/81 X
5,890,647 4/1999 Petkovsek .
5,915,730 6/1999 Petkovsek ..... 283/81 X
5,918,802 7/1999 Petkovsek .

LABEL SYSTEM AND METHOD FOR DELIVERING MAILPIECE WITH RETURN RECEIPT

BACKGROUND OF THE INVENTION

The present invention generally relates to an information label for attachment to a mailpiece, and more specifically the present invention relates to a mailing label having a removable receipt flap.

It is generally known to transport and deliver packages or articles via a mailing service where the time or day of delivery is critical. This type of service usually includes a mailing label or form attached to the package or article. A conventionally known mailing label of this type has several components including a top information receiving sheet, one or more carbonless print transfer layers for providing copies of the information sheet, a bottom layer for attachment to the package or article, and often a peel back sheet covering an adhesive layer on a back side of the bottom layer.

A typical mailing label for packages and articles to be mailed wherein the time or the day of delivery is critical includes multiple layers which are joined together along one side by a tear strip. The tear strip is usually an edge portion of each layer permanently adhered to one another and includes a perforated tear line for removing each layer sheet from the tear strip as needed. The upper most layer is an information sheet to which information regarding addressee and sender information may be added as is known in the art. The subsequent layers may have carbonless print transfer layers or sometimes further include intermediate carbon paper layers for transferring information printed on the uppermost information sheet to all of the layers of the label. The lower most layer sometimes includes an adhesive layer or backing for attaching the label to a package or article and further includes a removable adhesive cover sheet for protecting the adhesive until the label is to be attached to the article or package. One example of such a mailing label is the label assembly used for Express Mail packages by the United States Postal Service.

For a typical Express Mail label, one layer is usually returned to the mailing party for their files and for proof of mailing. This copy typically is one of the intermediate carbonless transfer layers and includes all of the information printed on or added to the information sheet. The other layers may go to various departments within the mail service provider for tracking and billing purposes. The uppermost sheet is retained on the label until delivery at which time delivery information is added to it. This loose sheet contains much information not needed on a return receipt and further may be damaged or accidentally torn from the label during shipping.

A need, therefore, exists to provide a mailing label having smaller sheets and a smaller removable receipt for proof of mailing containing only the necessary information thereon. A further need exists for a mailing label which provides a return receipt portion which is not loose and, therefore, not easily damaged during shipping.

SUMMARY OF THE INVENTION

The present invention provides a method and an apparatus for delivering a mailpiece wherein the method simplifies the delivery process and the acquisition of proof of mailing. The article provides a simpler and less expensive mailing label for a package or article to be mailed which also permits obtaining a simplified means for obtaining proof of delivery of the package or article and a more durable return receipt portion.

To this end, in an embodiment of the present invention, a label is provided for use in delivering an article and for indicating thereon mailing and address information relating to mailing, shipping and handling of the article. The label has a laminate with a primary layer and a secondary layer, each of the layers having a surface confronting and adjoined to one another. A removable receipt flap is formed from the primary layer, the removable receipt flap having mailing information therein. An area is disposed beneath the receipt flap formed from the secondary layer, the area being exposed when the receipt flap is removed from the primary layer and adapted to show a portion of the mailing information.

In one embodiment, the label has a layer of adhesive on a back side of the secondary layer.

In one embodiment, the label has a removable protective layer received over a back side of the secondary label.

In one embodiment, the label has a supplementary layer received over the secondary layer having a plurality of removable stickers carried thereon.

In one embodiment, the label has a tear line formed in the primary layer defining the receipt flap.

In one embodiment, the label is adapted for use by the United States Postal Service as an Express Mail label.

In one embodiment, the label has a generally rectangular configuration.

In one embodiment, the label has a tear line formed in the primary layer defining a generally rectangular receipt flap.

In one embodiment, the label has a tear strip disposed along one edge of the label and a cover sheet, wherein the cover sheet and the laminate are removably attached to the tear strip.

In one embodiment, the label has a transfer material adapted to transfer information added to the receipt flap onto the area beneath the receipt flap.

In one embodiment, the label has a removable fee flap containing thereon mailing fee information.

In one embodiment, the label has a removable. fee flap containing thereon mailing fee information and a layer of adhesive on a back side of the fee flap.

In one embodiment, the label has a supplementary layer disposed adjacent the secondary layer and a plurality of removable stickers carried on the supplementary layer.

In another embodiment of the present invention, a method of delivering an article is provided including the steps of: providing an article; providing a label having a primary layer and a secondary layer laminated together including a receipt flap in the primary layer bounded by a tear line and having thereon mailing information, and an area disposed beneath the receipt flap in the secondary layer to receive a portion of the additional information when added to the receipt flap; and adhering the label to the article.

In one embodiment, the method includes the step of providing an adhesive layer on a back side of the secondary layer.

In one embodiment, the method includes the steps of providing an adhesive layer on a back side of the secondary layer, providing a protective layer over the adhesive layer, removing the protective layer from the adhesive layer prior to the step of adhering the label, and placing the adhesive layer against the article.

In one embodiment, the method includes the step of removing the receipt flap from the label upon delivery of the article.

In one embodiment, the method includes the step of adding additional information to the receipt flap upon delivery of the article.

In one embodiment, the method includes the steps of providing a removable fee flap in the primary layer, removing the fee flap, and adhering the fee flap to the article prior to mailing.

In one embodiment, the method includes the step of providing a plurality of removable stickers on a back side of the secondary layer.

The present invention provides several advantages over known mailing labels. The mailing label of the invention provides a simple relatively inexpensive label construction requiring less paper product per label.

It further provides the advantage of incorporating a removable receipt which may contain any desired information.

It provides the further advantage of transferring information to the label which may be added to the receipt at the time of delivery prior to removing the receipt.

Another advantage of the present invention is that the label provides for an all-in-one construction wherein it may include a number of special instruction or informational stickers which are removable from the label and may be added to a package which is to be mailed. The label of the invention, therefore, provides a simple, relatively inexpensive, smaller label of the return receipt type which is superior to known prior art labels.

These and other advantages of the present invention are described in, and will be apparent from, the detailed description of the presently preferred embodiments and from the figures.

DETAILED DESCRIPTION OF THE PRESENTLY PREFERRED EMBODIMENTS

Figure 1:
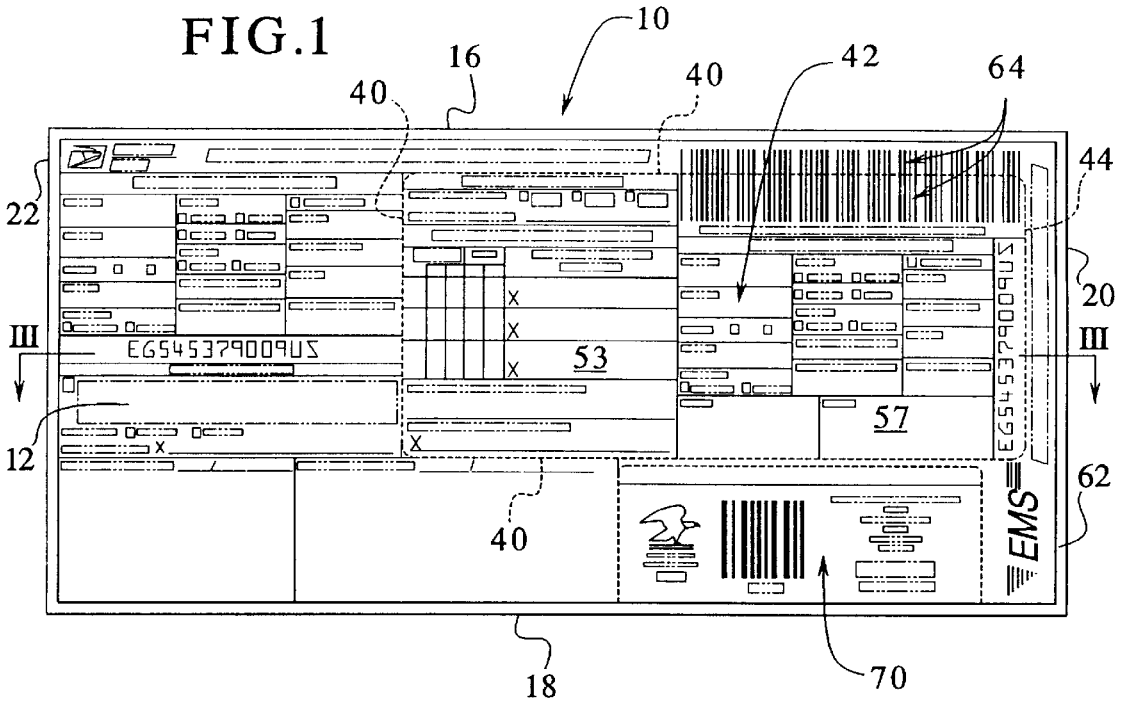
FIG. 1 illustrates a perspective view of an embodiment of a layered laminate mailing label constructed according to the present invention.

Referring now to the figures, wherein like numerals refer to like parts, FIG. 1 generally illustrates a perspective view of a mailing label 10 constructed according to the present invention. The label 10 includes an exposed front side 12 and a back side 14. For purposes of discussion and description, the label 10 will be described as having a top edge 16, an opposed bottom edge 18, and left and right side edges 20 and 22, respectively. The identification of top, bottom, and left and right sides is not intended to limit the invention in any way but is merely intended to assist in describing the article of the invention.

The label 10 of the invention is shown as having a finite length along the top and bottom edges 16 and 18 and a finite width along the left and right side edges 20 and 22, but it should be understood that a particular label or form constructed according to the present invention may vary considerably in size to satisfy the requirements of a particular mailing service without departing from the scope of the present invention. Additionally, a label constructed according to the invention may be utilized for many types of mail and delivery services for delivering packages and articles while satisfying the present invention. Still further, the label may be constructed as one of a plurality of continuously repeated labels on, for example, a continuous sheet of labels.

Figure 3:
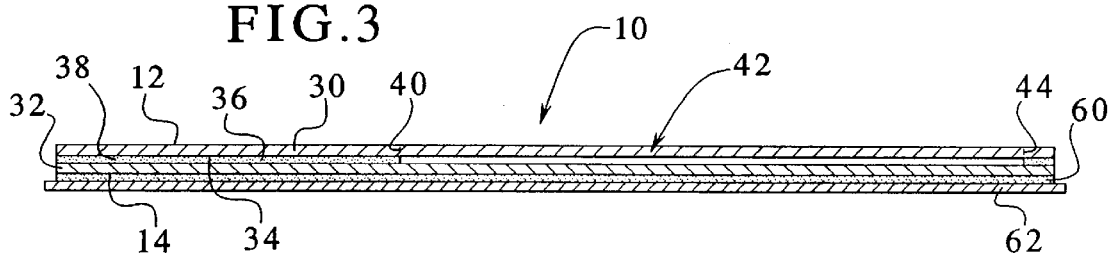
FIG. 3 illustrates a cross-sectional view of an embodiment of the mailing label of the present invention taken generally along line III—III of FIG. 1.
Figure 4:
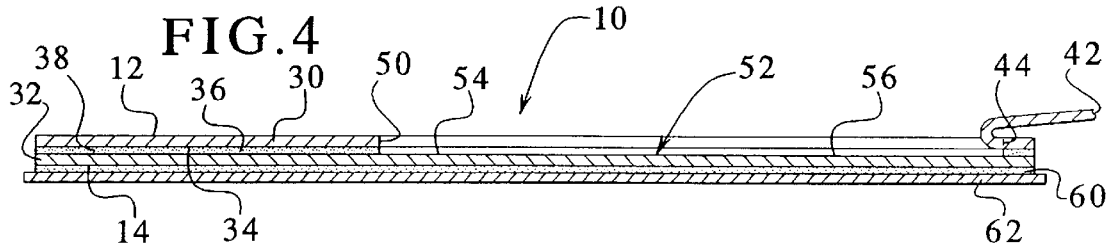
FIG. 4 illustrates a cross-sectional view of an embodiment of the mailing label of the present invention taken generally along line IV—IV of FIG. 2 wherein the removable receipt flap has been removed from the label.

As illustrated in FIGS. 3 and 4, the label 10 of the invention is of a laminate construction having a primary sheet or layer 30 with one of its surfaces defining the exposed front side of the label 10. The label 10 also includes a secondary sheet or layer 32 having one of its surfaces defining the exposed back side 14 of the label 10. The layers 30 and 32 may be constructed from any conventionally desirable paper product selected to accommodate specific printing or ink requirements or other such requirements as necessary for a particular mailing service.

The primary sheet 30 includes a surface 34 opposite the exposed front side 12, and similarly, the secondary sheet 32 includes a surface 36 opposite the back side 14 which confront and adhere to one another when the laminate label 10 is constructed. The surfaces 34 and 36 may be adhered to one another by any conventional known means, such as utilizing an adhesive, in order to ensure that the primary sheet 30 and the secondary sheet 32 remain adhered to one another throughout the mail delivery process. An adhesive layer 38 is indicated between the surfaces 34 and 36 in FIGS. 3 and 4.

Figure 2:
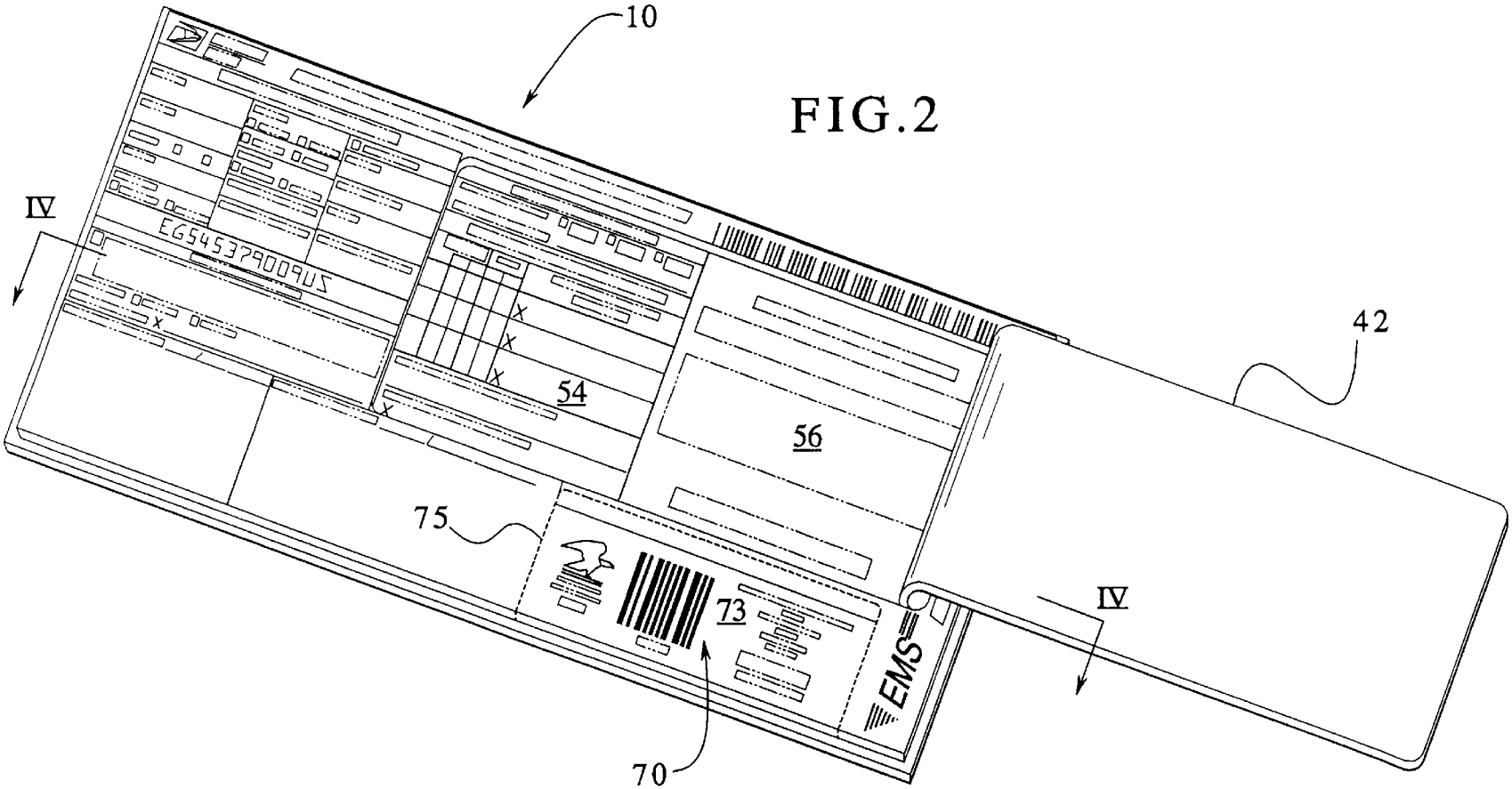
FIG. 2 illustrates a perspective view of an embodiment of the mailing label of the present invention wherein the removable receipt flap is partially lifted from the mailing label.

Referring now to FIGS. 1 and 2, a tear line 40 is provided on the exposed front side 12 of the label 10 and is illustrated in the present embodiment as a continuous line. The tear line 40 may be a score line, perforated tear line or the like. The tear line 40 in the present embodiment defines a rectangular receipt flap 42 in the primary layer 30 adjacent but spaced from the top and right edges 16 and 22, respectively. As will be evident to those skilled in the art, the size, shape and configuration of the receipt flap 42 as well as the location of the receipt flap 42 relative to the label 10 may vary considerably without departing from the scope of the present invention.

Additionally, the tear line 40 may be provided having numerous different constructions. For example, the tear line 40 may include at least one edge portion 44 having a different construction than the remainder of the perforated line such as a 50% cut line or a tear line having different perforations to ensure that the receipt flap 42 remains attached to the primary layer 30 until it is desired that it be removed. The tear line 40, therefore, may be a perforated tear line of the same form throughout or may be a combination of two or more kinds of perforated lines, cut lines or other such separable lines.

In one embodiment, illustrated generally in FIGS. 1 and 2, the exposed front side 12 includes printed information and instructions thereon and further includes defined spaces for information to be added thereto by individuals using the label 10 of the invention. For example, instructions, information and space may be provided for adding information regarding the sender, the addressee, delivery instructions, fee information and signatures to the exposed front side 12 beyond the boundary of the receipt flap 42. The receipt flap 42 also may include information and instructions along with space adapted for insertion of information regarding, for example, delivery information, recipient's signature, and, if desired, origin information thereon.

As illustrated in FIG. 2, when the receipt flap 42 is removed from the label 10, an opening 50 remains exposing an area 52 of the surface 36. The exposed area 52 may include the identical information, instructions and spaces as that of the receipt flap 42 or at least a portion thereof. For example, a section 53 of the receipt flap may include delivery information indicating time of delivery or attempted delivery and the signature of an individual receiving delivery. This same information may be transferred to and disposed on the exposed area 52 in a corresponding section 54 as shown in FIG. 2. Also, since some information included on the receipt flap 42 may be redundant, such as origin information, to the recipient of the article or package, a section 56 may be provided that includes information different than that in a corresponding location 57 on the receipt flap 42. Information such as, for example, customer claim instructions or other such instructions may be included in the section 56.

As discussed above, transfer of information written on the receipt flap 42 onto the appropriate corresponding portions of the exposed area 52 such as the section 54 is desirable. Therefore, either the material used to produce the primary layer 30 including the receipt flap 52 or the material used to produce the secondary layer 32, at least within the section 54 of the area 52, may include, for example, means for transferring information from one sheet to another as is known in the art. Preferably, a carbonless means for transferring may be implemented as is generally known by those skilled in the art.

Figure 5:
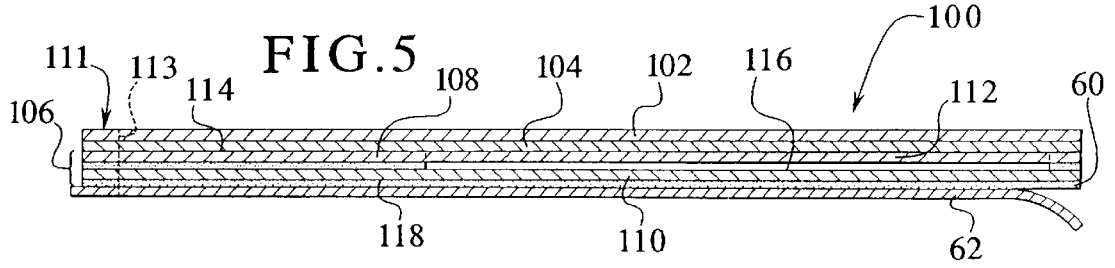
FIG. 5 illustrates a sectional view of an embodiment of a layered laminate mailing form including a layered laminate label constructed according to the present invention.

An alternative embodiment is illustrated in FIG. 5 to incorporate the invention into a more conventional label. FIG. 5 illustrates a form 100 in cross-section incorporating a cover layer 102, an intermediate layer 104 and a label portion 106. The label portion 106 has a construction corresponding to that of the label 10 described above and has a primary layer 108 and a secondary layer 110 laminated to one another. The primary layer 108 includes a receipt flap 112 which corresponds to the receipt flap 42 as described above. In this embodiment, the cover layer 102, the intermediate layer 104, and the label portion 106 are joined via individual perforated tear lines 113 along one edge to a removable tear strip 111 as is known and utilized for a conventional mailing form such as an Express Mail label.

In this embodiment, the cover layer 102 contains the same information as that on the exposed front side 12 of the label 10. In such an embodiment, either the cover layer 102 or primary layer 108 may include a carbonless copy or transfer features such that any information added or written onto the cover layer 102 may be copied or transferred onto an exposed front side 114 of the primary layer 108 and further onto an area 116 of the secondary layer 110 similar to the area 52 for the label 10. The cover layer 102 may, therefore, provide an additional sheet to give to the sender for their records at the time of submitting a package or article to the mailing service.

In another embodiment, the label 10 and the form 100 may also include, on their respective back sides 14 and 118, a layer of adhesive 60. The adhesive 60 is shown in FIGS. 3 and 5 but as will be evident to those skilled in the art, the adhesive 60 need not be utilized for the label or form to fall within the scope of the present invention. A protective layer or peel away sheet 62 may also be included covering the adhesive 60 until such time as the labels are attached to an article or package for mailing as is known in the art.

The exposed front side 12 of the label 10 and similarly the exposed front side 114 of the form lo may include a variety of information thereon. For example, as is illustrated in FIG. 1, the label 10 may include conventional bar coding 64 extending partly onto the receipt flap 42 for each label and partly onto the exposed front side 14 so that when the receipt flap 42 is removed, the bar coding 64 is both on the flap and on the remaining portion of the label 10. This bar coding 64 typically includes the tracking number, such as an Express Mail number, for example, which is utilized for many purposes including tracking the article during the delivery process and/or for billing purposes.

The labels may also include a portion as is denoted in the label 10 at section 70 for indicating the mailing fee information thereon. In one embodiment, a standard mailing fee may be preprinted on a particular label for packages having standard fees such as letters. In another embodiment, the fee section may include spaces for adding fee information for particular packages or articles upon determination of the proper fee.

Figure 6:
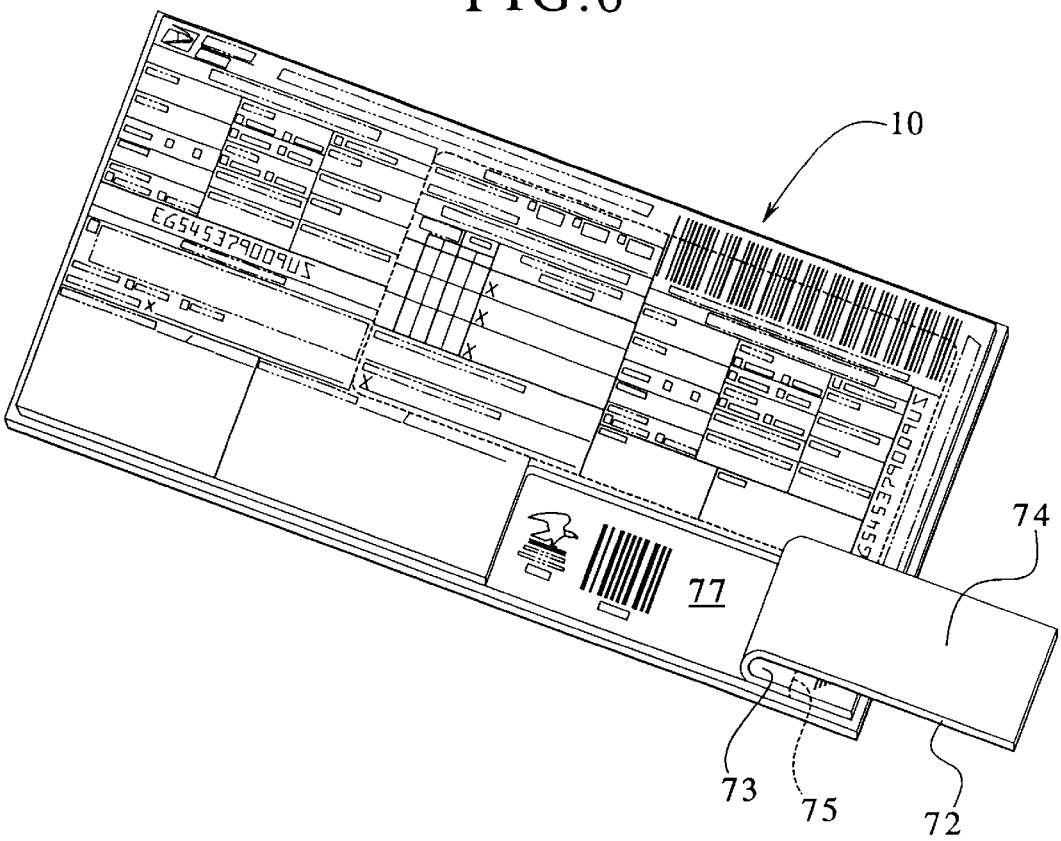
FIG. 6 illustrates a perspective view of another embodiment of a layered laminate mailing label constructed according to the present invention.

In one embodiment, the section 70 may be in the form of a fee flap 72 as illustrated in FIG. 6. The fee flap 72 may be constructed in various manners without departing from the scope of the present invention. For example, the fee flap 72 may include an exposed side 73 having the mailing fee information printed thereon and an opposite side 74 facing the secondary layer 32 of the label 10. In this embodiment, the fee flap 72 is formed as part of the primary layer 30 and defined by a continuous perforated tear line 75 similar to that of the receipt flap 42 as described above. In one embodiment, the fee flap 72 may include on the back side 74 an adhesive which may either be a self stick adhesive, a layer of adhesive requiring water such as that used for conventional stamps, or other such adhesive for adhering the fee flap 72 to the article or package when removed from the label 10.

In another embodiment, the fee flap 72 may incorporate a carbonless transfer means similar to that described for the receipt flap 42. Thus, any fee information which is printed on the exposed side 73 of the receipt 42 flap may be transferred to the secondary layer in the area 77 exposed when the fee flap 72 is removed from the label 10. This will provide a record of the fee for mailing the package or article if the label 10 is not delivered with the article or package.

Figure 8:
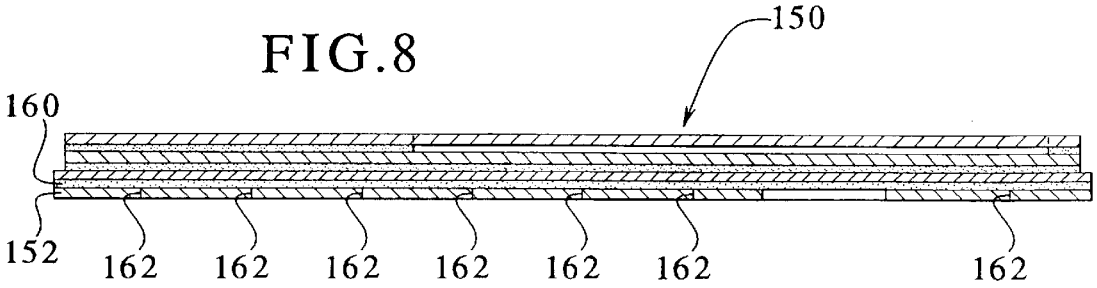
FIG. 8 illustrates a cross-sectional view of an embodiment of the mailing label of the present invention taken generally along line VIII—VIII of FIG. 7.
Figure 7:
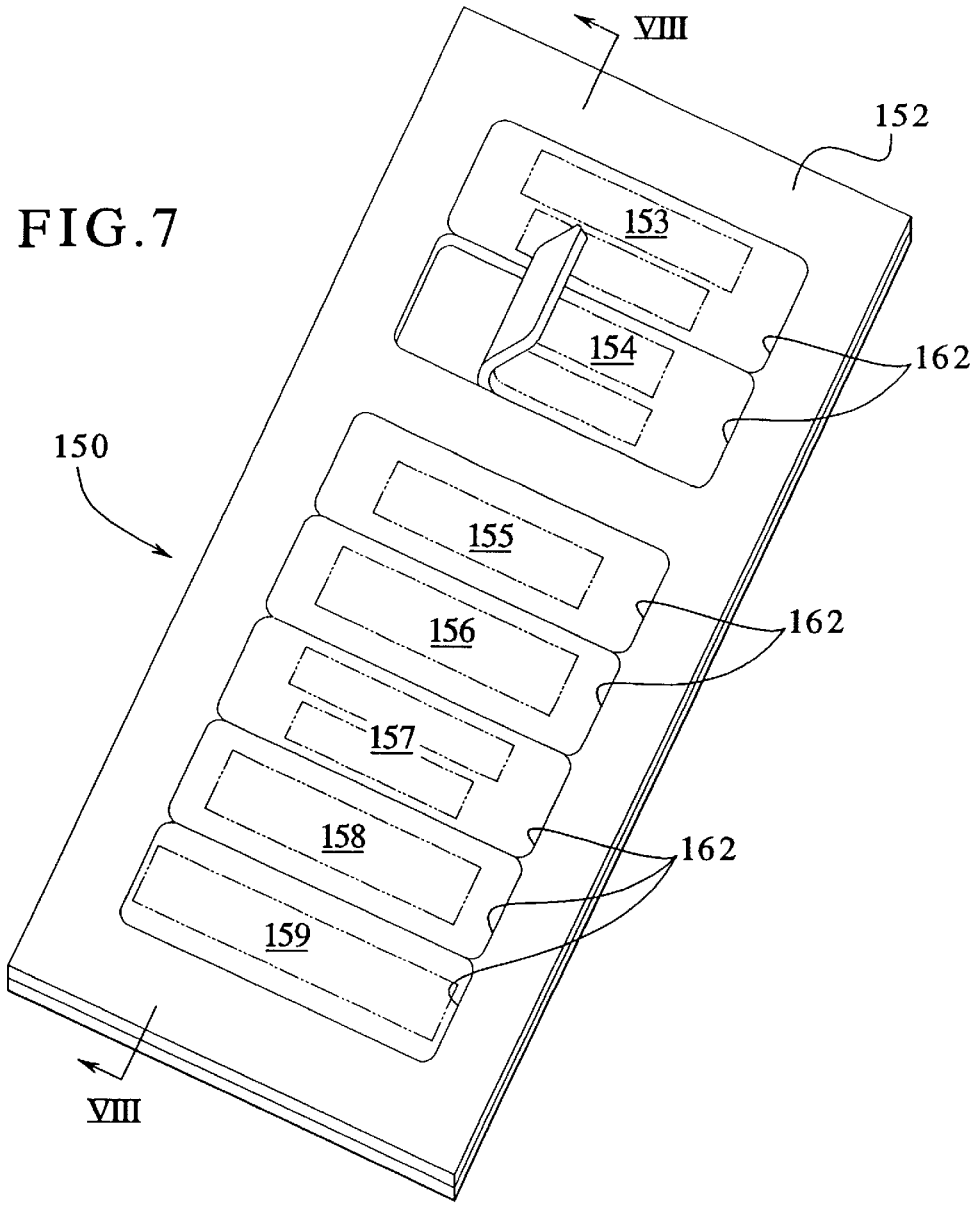
FIG. 7 illustrates a bottom plan view in perspective of another embodiment of a layered laminate mailing label constructed according to the present invention.
Figure 9:
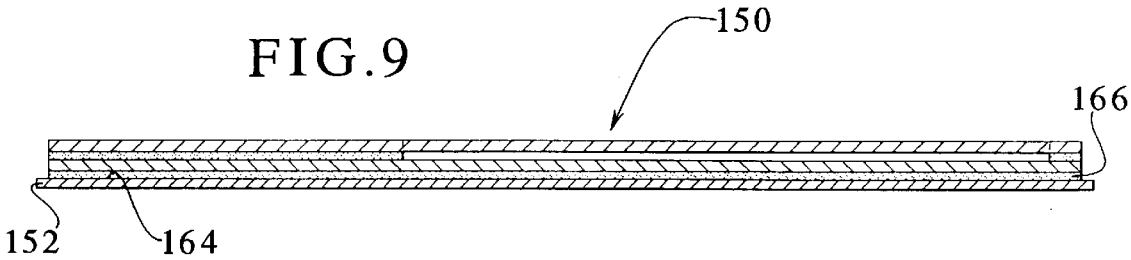
FIG. 9 illustrates a sectional view of an alternative embodiment of the mailing label of the present invention illustrated generally in FIG. 7.

As illustrated in FIGS. 7–9, another embodiment of a label 150 constructed in accordance with the present invention includes a supplementary layer 152 at the exposed bottom side of the label. The supplementary layer 152 of the present embodiment includes a plurality of optional stickers individually separable from the supplementary layer 152 for attachment to the package or article. The stickers may include special delivery information or instructions, such as a "Weekend Delivery" sticker 153, "Holiday Delivery" sticker 154, "COD" sticker 155, "Military" sticker 156, "Signature Required" sticker 157, "2nd Day" sticker 158 and/or a "Next Day" sticker 159 as generally illustrated in FIG. 7. Of course, other designations may be implemented or customized for a particular application as necessary.

The supplementary layer 152 may be incorporated into a label constructed as shown and described for the label 10 above in one of several manners. For example, if the label 10 includes the adhesive layer 60 and the protective layer 62 thereover as shown and described, the supplementary layer 152 may include on its reverse side an adhesive material 160 for adhering to the exterior surface of the protective layer 62 as shown in FIG. 8. In this embodiment, each of the individual stickers 153–159 of the supplementary layer 152 may be defined within the layer by cut lines 162 as illustrated in FIG. 7. Each of the stickers may then be peeled individually from the label 150 shown in FIG. 7 by separating a desired sticker from the supplementary layer 152 and pulling the sticker so that the adhesive releases from the exterior surface of the protective layer 62.

FIG. 9 illustrates an alternative construction for the label 150 in cross-sectional view wherein the label portion corresponds to the label 10 as described above, except not including the adhesive 60 or the protective layer 62. In this construction, the supplementary layer 152 includes a back side 164 facing the back side 14 of the label 10. The supplementary layer 152 in this embodiment may include a releasable adhesive 166 on the back side 156, and the secondary layer 32 may include a surface defining the exposed back side 14 adapted to permit the supplementary layer 152 to adhere thereto and further release the adhesive therefrom along with one or more of the stickers 153–159 when separated from the supplementary layer 152. In this embodiment, the label 10 including the supplementary layer 152 is particularly useful for an article or package including a transparent pouch as is conventionally known in the art.

As will be evident to those skilled in the art,.the present invention is not to be limited to any type of specific information included on the labels. As will also be evident to those skilled in the art, the labels 10 and 150 and the form 100 described herein may be useful for many different types of packages, and are particularly suitable for article delivery and/or tracking.

To utilize the labels 10 and 150 and the form 100 of the invention, a package or article is prepared for mailing and, for example, the label 10 is filled out to include all pertinent and necessary information on the exposed front side 12. The label 10 is then adhered to the mailpiece, for example, by removing the protective layer 62 to expose the adhesive 60 and then adhering the label 10 to the mailpiece. Alternatively, it is known in the art to provide a transparent flap or pouch attached to a package or article for inserting the label 10 therein exposing the printed information and instructions through the transparent material. The label 150 and the form 100 may also be attached to the article or package in a similar manner as the label 10. If the label 10 includes the fee flap 72 as described above, the fee flap 72 may be removed from the label 10 and adhered to the mailpiece in the appropriate place. Further, one or more of the stickers 153-159 may be removed from the supplementary layer 152 of the label 150 and added to the mailpiece.

Upon submission of the mailpiece to the delivering party, further pertinent information may be added to the exposed front side 12, such as the weight of the package and costs associated with delivering the package of a particular weight. In the embodiment illustrated in FIG. 5, the information may be added to and then the cover sheet 102 may be removed from the remainder of the form 100 and provided to the sender for their records.

Through the conventional systems of delivering a mailpiece, the mailpiece eventually arrives at the addressee's location. At such time, delivery information is filled in on the receipt flap 42 providing a record of information desired for proof of delivery. Upon entering the desired information, the receipt flap 42 is removed by tearing along the tear lines 40 and, if present, 44 for return thereof to the appropriate party.

Of course, this particular arrangement is suitable for many types of articles and packages to be delivered or shipped. The invention is, therefore, not to be construed or limited to Express Mail service delivery or even to mail delivery, but should rather encompass any type of package or article onto which a mailing or delivery slip may be placed, particularly those requiring a return receipt or acknowledgment of delivery.

Furthermore, printing of labels constructed in accordance with the present invention may be conducted in any known manner. The present invention is not to be limited in the manner in which the label itself is printed or the manner in which additional information is added to the label by those using it.

It should be understood that various changes. and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A method of delivering an article, the method comprising the steps of:

providing an article;

providing a label having a primary layer and a secondary layer laminated together including a receipt flap in the primary layer bounded by a tear line wherein a portion of the tear line is distinct from a remainder of the tear line and further wherein the receipt flap has mailing information printed thereon wherein the mailing information includes a first section of information relating to delivery of the article and a second section of information, and further wherein the label has an area disposed directly beneath the receipt flap wherein the area is only exposed when the receipt flap is removed from the primary layer and further wherein the area is adapted to show the first section of the printed mailing information and further wherein the area disposed directly beneath the receipt flap in the secondary layer further containing information distinct from that contained on the receipt flap and further wherein the area does not show the second section of the information from the receipt flap and further wherein the label has a supplementary layer adjacent the secondary layer wherein the supplementary layer has a backside and further wherein the backside of the supplementary layer has a plurality of removable stickers therein; and adhering the label to the article.

2. A method of delivering an article, the method comprising the steps of:

providing an article;

providing a label having a primary layer and a secondary layer laminated together including a receipt flap in the primary layer bounded by a tear line and having mailing information printed thereon wherein the mailing information includes a first section of information relating to delivery of the article and a second section of information, and further wherein the label has an area disposed directly beneath the receipt flap wherein the area is only exposed when the receipt flap is removed from the primary layer and further wherein the area is adapted to show the first section of the printed mailing information and further wherein the area disposed directly beneath the receipt flap in the secondary layer further containing information distinct from that contained on the receipt flap and further wherein the area does not show the second section of the information from the receipt flap and further wherein the label has a supplementary layer adjacent the secondary layer wherein the supplementary layer has a backside and further wherein the backside of the supplementary layer has a plurality of removable stickers therein; and adhering the label to the article.

3. A method of delivering an article, the method comprising the steps of:

providing an article;

providing a label having a primary layer and a secondary layer laminated together including a receipt flap in the primary layer bounded by a tear line and further wherein the receipt flap has mailing information printed thereon wherein the mailing information includes a first section of information relating to delivery of the article and a second section of information, and further wherein the label has an area disposed directly beneath the receipt flap wherein the area is only exposed when the receipt flap is removed from the primary layer and further wherein the area includes a first portion disposed beneath the first section of the receipt flap and is adapted to show the first section of the printed mailing information and further wherein the area has a second portion disposed beneath the second section of the receipt flap showing information distinct from the second section of the receipt flap and further wherein the area does not show the second section of the information from the receipt flap and further wherein the label has a means for transferring information between the first section of the receipt flap and the first portion of the area wherein the material is disposed only beneath the first section wherein the transferring means reproduces printed information on the first section to the first portion of the area and further wherein the information printed on the second section of the receipt flap is not transferred to the second portion of the area; and adhering the label to the article.

4. The method according to claim 3 further comprising the step of:

providing an adhesive layer on a back side of the secondary layer.

5. The method according to claim 3 further comprising the steps of:

providing an adhesive layer on a back side of the secondary layer;

providing a protective layer over the adhesive layer;

removing the protective layer from the adhesive layer; and placing the adhesive layer against the article.

6. The method according to claim 3 further comprising the step of:

removing the receipt flap from the label upon delivery of the article.

7. The method according to claim 3 further comprising the step of:

adding additional information to the receipt flap upon delivery of the article.

8. The method according to claim 3 further comprising the steps of:

providing a removable fee flap in the primary layer;

removing the fee flap; and adhering the fee flap to the article prior to mailing.

9. The method according to claim 3 further comprising the step of:

providing a supplementary layer adjacent the secondary layer;

providing a plurality of removable stickers in a back side of the supplementary layer.

10. A method of delivering an article, the method comprising the steps of:

providing an article;

providing a label having a primary layer and a secondary layer laminated together including a receipt flap in the primary layer bounded by a tear line and further wherein the receipt flap has a first section having mailing information thereon and a second section, and further wherein the label has an area disposed beneath the receipt flap in the secondary layer having a first portion disposed beneath the first section of the receipt flap and adapted to receive the information from the first section of the receipt flap when added to the receipt flap and further wherein the area has a second portion disposed beneath the second section of the receipt flap showing information distinct from the second section of the receipt flap and further wherein the label has means for transferring information between the first section of the receipt flap and the first portion of the area disposed only beneath the first section of the receipt flap wherein the transferring means reproduces the printed information on the first section of the receipt flap and further wherein the information printed on the second section of the receipt flap is not transferred to the second portion of the area and further wherein the label has a plurality of removable stickers on the secondary layer;

removing at least one of the removable stickers;

adhering the at least one of the removable stickers to the article prior to mailing; and adhering the label to the article.

11. A label for use in delivering an article and for indicating thereon mailing and address information relating to mailing, shipping, and handling of the article, the label comprising:

a laminate having a primary layer and a secondary layer, each of the layers having a first surface confronting and adjoined to one another;

a removable receipt flap formed from the primary layer, the receipt flap having mailing information printed thereon wherein the mailing information includes a first section of information relating to delivery of the article and a second section of information;

an area formed from the secondary layer disposed directly beneath the receipt flap wherein the area is only exposed when the receipt flap is removed from the primary layer and further wherein the area includes a first portion disposed beneath the first section of the receipt flap and adapted to show the first section of the printed mailing information and further wherein the area has a second portion disposed beneath the second section showing information distinct from the second section of the receipt flap and further wherein the area does not show the second section of the information from the receipt flap;

means for transferring information between the first section of the receipt flap and the first portion of the area wherein the transferring means is disposed only beneath the first section of the receipt flap wherein the transferring means reproduces the printed information on the first section of the receipt flap and further wherein the information printed on the second section of the receipt flat is not transferred to the second portion of the area; and a tear line formed in the primary layer defining the receipt flap.

12. The label according to claim 11 further comprising:

a layer of adhesive on a back side of the secondary layer.

13. The label according to claim 11 further comprising:

a removable protective layer received over a back side of the secondary layer.

14. The label according to claim 11 further comprising:

a supplementary layer on a second surface of the secondary layer opposite the first surface that is joined to the primary layer, the supplementary layer having a plurality of removable stickers carried therein.

15. The label according to claim 11 adapted for use by the United States Postal Service as an Express Mail label.

16. The label according to claim 11 having a generally rectangular configuration.

17. The label according to claim 11 further comprising:

a tear strip disposed along one edge of the label; and a cover sheet attached to the laminate and adjacent to a second surface of the primary layer wherein the secondary layer is on a first surface of the primary layer wherein the first surface and the second surface are oppositely facing surfaces of the primary layer and further wherein the cover sheet and the laminate are removably attached to the tear strip.

18. The label according to claim 11 further comprising:

a transfer material adapted to transfer information added to the receipt flap onto the area beneath the receipt flap.

19. The label according to claim 11 further comprising:

a removable fee flap containing thereon mailing fee information.

20. The label according to claim 11 further comprising:

a removable fee flap containing thereon mailing fee information; and a layer of adhesive on a back side of the fee flap.

21. The label according to claim 11 further comprising:

a supplementary layer disposed adjacent to a second surface of the secondary layer wherein the primary layer is on a first surface of the secondary layer wherein the first surface and the second surface are oppositely facing surfaces of the secondary layer; and a plurality of removable stickers carried in the supplementary layer.

22. A label for use in delivering an article and for indicating thereon mailing and address information relating to mailing, shipping and handling of the article, the label comprising:

a laminate having a primary layer and a secondary layer, each of the layers having a surface confronting and enjoined to one another;

a removable receipt flap formed from the primary layer, the receipt flap having mailing information thereon;

an area formed from the secondary layer disposed beneath the receipt flap, the area exposed when the receipt flap is removed from the primary layer and adapted to show a portion of the mailing information; and a supplementary layer on a back side of the secondary layer opposite the surface joined to the primary layer, the supplementary layer having a plurality of removable stickers carried therein.

23. A label for use in delivering an article and for indicating thereon mailing and address information relating to mailing, shipping, and handling of the article, the label comprising:

a laminate having a primary layer and a secondary layer, each of the layers having a first surface confronting and adjoined to one another;

a removable receipt flap formed from the primary layer, the receipt flap having mailing information thereon;

an area formed from the secondary layer disposed beneath the receipt flap, the area exposed when the receipt flap is removed from the primary layer and adapted to show a portion of the mailing information and further wherein the area disposed beneath the receipt flap includes an area having information that does not correspond to the mailing information on the receipt flap;

a supplementary layer disposed adjacent to a second surface of the secondary layer wherein the first surface of the secondary layer and the second surface of the secondary layer are oppositely facing surfaces of the secondary layer; and a plurality of removable stickers carried in the supplementary layer.

24. A label for use in delivering an article and for indicating thereon mailing and address information relating to mailing, shipping, and handling of the article, the label comprising:

a laminate having a primary layer and a secondary layer, each of the layers having a first surface confronting and adjoined to one another;

a removable receipt flap formed from the primary layer, the receipt flap having mailing information printed thereon wherein the mailing information includes a first section of information relating to delivery of the article and a second section of information;

an area formed from the secondary layer disposed directly beneath the receipt flap wherein the area is only exposed when the receipt flap is removed from the primary layer and adapted to show both the first section of the printed mailing information and information that does not correspond to the mailing information on the receipt flap and further wherein the area does not show the second section of the information from the receipt flap; and a supplementary layer on a second surface of the secondary layer opposite the first surface that is joined to the primary layer, the supplementary layer having a plurality of removable stickers carried therein.

25. A label for use in delivering an article and for indicating thereon mailing and address information relating to mailing, shipping, and handling of the article, the label comprising:

a laminate having a primary layer and a secondary layer, each of the layers having a first surface confronting and adjoined to one another;

a removable receipt flap formed from the primary layer, the receipt flap having mailing information printed thereon wherein the mailing information includes a first section of information relating to delivery of the article and a second section of information;

an area formed from the secondary layer disposed directly beneath the receipt flap wherein the area is only exposed when the receipt flap is removed from the primary layer and adapted to show both the first section of the printed mailing information and information that does not correspond to the mailing information on the receipt flap and further wherein the area does not show the second section of the information from the receipt flap;

a supplementary layer disposed adjacent to a second surface of the secondary layer wherein the primary layer is on a first surface of the secondary layer wherein the first surface and the second surface are oppositely facing surfaces of the secondary layer; and a plurality of removable stickers carried in the supplementary layer.

26. A label for use in delivering an article and for indicating thereon mailing and address information relating to mailing, shipping, and handling of the article, the label comprising:

a laminate having a primary layer and a secondary layer, each of the layers having a first surface confronting and adjoined to one another;

a removable receipt flap formed from the primary layer, the receipt flap having mailing information printed thereon wherein the mailing information includes a first section of information relating to delivery of the article and a second section of information;

an area formed from the secondary layer disposed directly beneath the receipt flap wherein the area is only exposed when the receipt flap is removed from the primary layer and adapted to show both the first section of the printed mailing information and information that does not correspond to the mailing information on the receipt flap and further wherein the area does not show the second section of the information from the receipt flap;

a tear line formed in the primary layer defining the receipt flap wherein a portion of the tear line has a different construction than a remainder of the tear line; and a supplementary layer on a second surface of the secondary layer opposite the first surface that is joined to the primary layer, the supplementary layer having a plurality of removable stickers carried therein.

27. A label for use in delivering an article and for indicating thereon mailing and address information relating to mailing, shipping, and handling of the article, the label comprising:

a laminate having a primary layer and a secondary layer, each of the layers having a first surface confronting and adjoined to one another;

a removable receipt flap formed from the primary layer, the receipt flap having mailing information printed thereon wherein the mailing information includes a first section of information relating to delivery of the article and a second section of information;

an area formed from the secondary layer disposed directly beneath the receipt flap wherein the area is only exposed when the receipt flap is removed from the primary layer and adapted to show both the first section of the printed mailing information and information that does not correspond to the mailing information on the receipt flap and further wherein the area does not show the second section of the information from the receipt flap;

a tear line formed in the primary layer defining the receipt flap wherein a portion of the tear line is distinct from a remainder of the tear line;

a supplementary layer disposed adjacent to a second surface of the secondary layer wherein the primary layer is on a first surface of the secondary layer wherein the first surface and the second surface are oppositely facing surfaces of the secondary layer; and a plurality of removable stickers carried in the supplementary layer.

* * * * *

UNITED STATES PATENT AND TRADEMARK OFFICE

CERTIFICATE OF CORRECTION

PATENT NO. : 6,136,129
DATED : October 24, 2000
INVENTOR(S) : Petkovsek

It is certified that error appears in the above-identified patent and that said Letters Patent is hereby corrected as shown below:

Column 6,
Line 11, change “lo” to numeral “100” in bold type

Column 7,
Line 32, change “art,.” to -- art, --

Column 8,
Line 21, delete period after “changes”

Signed and Sealed this

Twenty-ninth Day of June, 2004

JON W. DUDAS
*Acting Director of the United States Patent and Trademark Office*